US007175107B2

(12) United States Patent
Amaduzzi

(10) Patent No.: US 7,175,107 B2
(45) Date of Patent: Feb. 13, 2007

(54) MULTI-FUNCTION HEAD FOR HIGH-PRESSURE WATER GUN, IN PARTICULAR FOR WATER CLEANING MACHINES

(75) Inventor: Roberto Amaduzzi, Rubiera (IT)

(73) Assignee: Arrow Line S.r.l., Rubiera (IT)

( * ) Notice: Subject to any disclaimer, the term of this patent is extended or adjusted under 35 U.S.C. 154(b) by 226 days.

(21) Appl. No.: 10/910,610

(22) Filed: Aug. 4, 2004

(65) Prior Publication Data

US 2005/0035215 A1 Feb. 17, 2005

(30) Foreign Application Priority Data

Aug. 7, 2003 (IT) ..... RE2003A0076

(51) Int. Cl.
*B05B 3/06* (2006.01)

(52) U.S. Cl. ..... 239/251; 239/569; 239/457; 239/581.1; 239/477; 239/501; 239/240; 239/463

(58) Field of Classification Search ..... 239/451, 239/457, 456, 548, 569, 579, 581.1, 582.2, 239/463, 477, 501, 581.2
See application file for complete search history.

(56) References Cited

U.S. PATENT DOCUMENTS 2,582,262 A * 1/1952 Otto et al. ..... 251/303
2,662,669 A * 12/1953 Schmidt ..... 222/402.21
5,240,183 A * 8/1993 Bedaw et al. ..... 239/403
5,551,635 A * 9/1996 Jager ..... 239/240
6,129,293 A * 10/2000 Jager ..... 239/227
6,755,358 B2 * 6/2004 Jaeger ..... 239/381

FOREIGN PATENT DOCUMENTS

EP 0 548 408 6/1993
EP 1 000 665 5/2000

* cited by examiner

*Primary Examiner*—David A. Scherbel
*Assistant Examiner*—Trevor McGraw
(74) *Attorney, Agent, or Firm*—Young & Thompson

(57) ABSTRACT

The high-pressure multi-function head especially for water-cleaning machines comprises a first main body which exhibits a conduit for a washing liquid, extending along a longitudinal axis from an inlet to an outlet and a portion having a narrowed transversal section; a nozzle housed in the conduit; an auxiliary body inserted in the conduit and constituting a frustoconical seating for a front end of the nozzle; means for conveying the washing liquid interpositioned between the inlet and the portion having a narrowed transversal section and forming upstream of the nozzle at least one oblique jet with respect to the longitudinal axis in order to give the nozzle a rotating and conical motion with a vertex in the frustoconical seating; and means for regulating a trim of the head for translating the auxiliary body and the nozzle along the longitudinal axis between a retracted first operating position for obtaining a high-pressure rotating jet, an intermediate second operating position, for obtaining a high-pressure fixed jet, and an advanced third operating position, for obtaining a low-pressure fixed jet.

11 Claims, 5 Drawing Sheets

MULTI-FUNCTION HEAD FOR HIGH-PRESSURE WATER GUN, IN PARTICULAR FOR WATER CLEANING MACHINES

BACKGROUND OF THE INVENTION

High-pressure water guns, as is known, terminate with a head comprising a mostly tubular main body and a rear portion to which an inlet connection is coupled, which connection exhibits an inlet conduit for a washing liquid. A nozzle for the liquid is housed internally of a front cavity in the main body.

Numerous types of head are known for high-pressure cleaning machines.

In some types, the nozzle is fixed internally of the main body and only a high-pressure directional jet is possible, or a fanned spray jet, having a variable angle of spread.

In other fixed-nozzle types, apart from the above functions, a low-pressure jet can also be obtained for aspiration of a detergent by means of an ejector installed in the water-cleaning machine.

Also known are rotating-nozzle heads provided with a mobile nozzle internally of the front cavity, which cavity is conformed and of adequate dimensions so as to be suitable for the motion of the nozzle.

The nozzle is located frontally and abuts an annular seating inserted in the front cavity of the main body, where it is made to rotate about itself internally of the annular seating and along a conical trajectory with vertices in the annular seating, by a jet of liquid which is oblique with respect to the longitudinal axis of the main body. The oblique jet is obtained by special means for conveying interpositioned between the inlet conduit and the front cavity of the main body. Thus a jet issues from the head which jet rotates with a trajectory similar to that of the nozzle head.

If other functions are required apart from the above-described rotating jet, for example a high-pressure directed jet and/or a low-pressure fanned spray jet, the prior art includes use of several interchangeable heads, each able to offer one or two functions, with obvious drawbacks relating to awkwardness and economy, or the use of heads each having three or four functions, where the flow is deviated into three or four different channels to supply different devices which are separate.

The prior-art heads exhibit numerous limitations and drawbacks.

Firstly, they are considerably unwieldy and complex from a constructional point of view. Production costs are therefore quite relevant.

Further, the prior art is sometimes poor from the point of view of performance, for example in terms of poor jet alignment with respect to the longitudinal axis of the heads.

U.S. Pat. No. 5,551,635 teaches a multi-function head for high-pressure water-cleaning machines which comprises an internal tubular body provided with an axial passage and an inlet for water. An external tubular body coaxially surrounds the internal body, is rotatable with respect to the internal body but axially fixed with respect thereto. A regulator element is mounted in the external body and is coupled to the internal body, so as to be axially mobile with respect to the internal body but fixed in rotary motion thereto. The axial motion of the regulation element with respect to the internal body is rendered by a cam which is solidly constrained to the external body. The head further comprises a front valve body connected to the regulation element, a rear valve body, axially aligned to the front valve body at a flat contact surface, and a rotating nozzle the front end of which is engaged in a frustoconical seating of the rear valve body. The front valve body, the rear valve body and the rotating nozzle are crossed by a conduit for water passage.

The rear end of the rotating nozzle is provided with an elastomer ring by means of which the rear end rolls in the axial passage of the internal body.

The axial passage is posteriorly delimited by a frustoconical guide provided with openings for inlet of the water flow, in which guide the rear end of the rotating nozzle can engage.

The front valve body, the rear valve body and the rotating nozzle are axially mobile in the internal body, by rotation of the external body and the motion of the regulating element. Further, the front valve body is axially mobile with respect to the rear valve body.

In a first operating condition, the front valve body is distanced from the rear valve body and the water passes through the conduit into the rotating nozzle and though passages surrounding the rear valve body. When the front valve body is moved towards the rear valve body, the two bodies enter into contact and the water can pass only through the conduit into the rotating nozzle. The rear end of the rotating nozzle is free to rotate in order to produce a rotating flow. If the front valve body is further displaced towards the frustoconical guide, the rear end of the rotating nozzle is confined within the guide itself and the diameter of the trajectory of the circular motion is progressively reduced. Finally, the rear end of the rotating nozzle is blocked in the base of the guide, preventing rotation in order to produce a fixed flow.

The applicant has found that this type of head too is susceptible to various improvements, in particular in relation to the performance provided and reliability over a length of time.

The technical aim at the base of the invention is to create a multi-function head for high-pressure water guns which obviates the above-cited drawbacks.

An important aim of the invention is to provide a multi-function head, comprising rotation of the nozzle, which is compact, light, constructionally simple and economic to make.

The technical aim is attained by a multi-function head which is characterised in that it comprises one or more of the solutions claimed in the appended claims.

SUMMARY OF THE INVENTION

The high-pressure multi-function head especially for water-cleaning machines comprises a first main body which exhibits a conduit for a washing liquid, extending along a longitudinal axis from an inlet to an outlet and a portion having a narrowed transversal section; a nozzle housed in the conduit; an auxiliary body inserted in the conduit and constituting a frustoconical seating for a front end of the nozzle; means for conveying the washing liquid interpositioned between the inlet and the portion having a narrowed transversal section and forming upstream of the nozzle at least one oblique jet with respect to the longitudinal axis in order to give the nozzle a rotating and conical motion with a vertex in the frustoconical seating; and means for regulating a trim of the head for translating the auxiliary body and the nozzle along the longitudinal axis between a retracted first operating position for obtaining a high-pressure rotating jet, an intermediate second operating position, for obtaining a high-pressure fixed jet, and an advanced third operating position, for obtaining a low-pressure fixed jet.

BRIEF DESCRIPTION OF THE DRAWINGS

Two preferred but not exclusive embodiments are now described by way of non-limiting example, of a multi-function head for water-cleaning guns according to the invention, illustrated in the accompanying figures of the drawings, in which.

DESCRIPTION OF THE PREFERRED EMBODIMENTS

Figure 1:
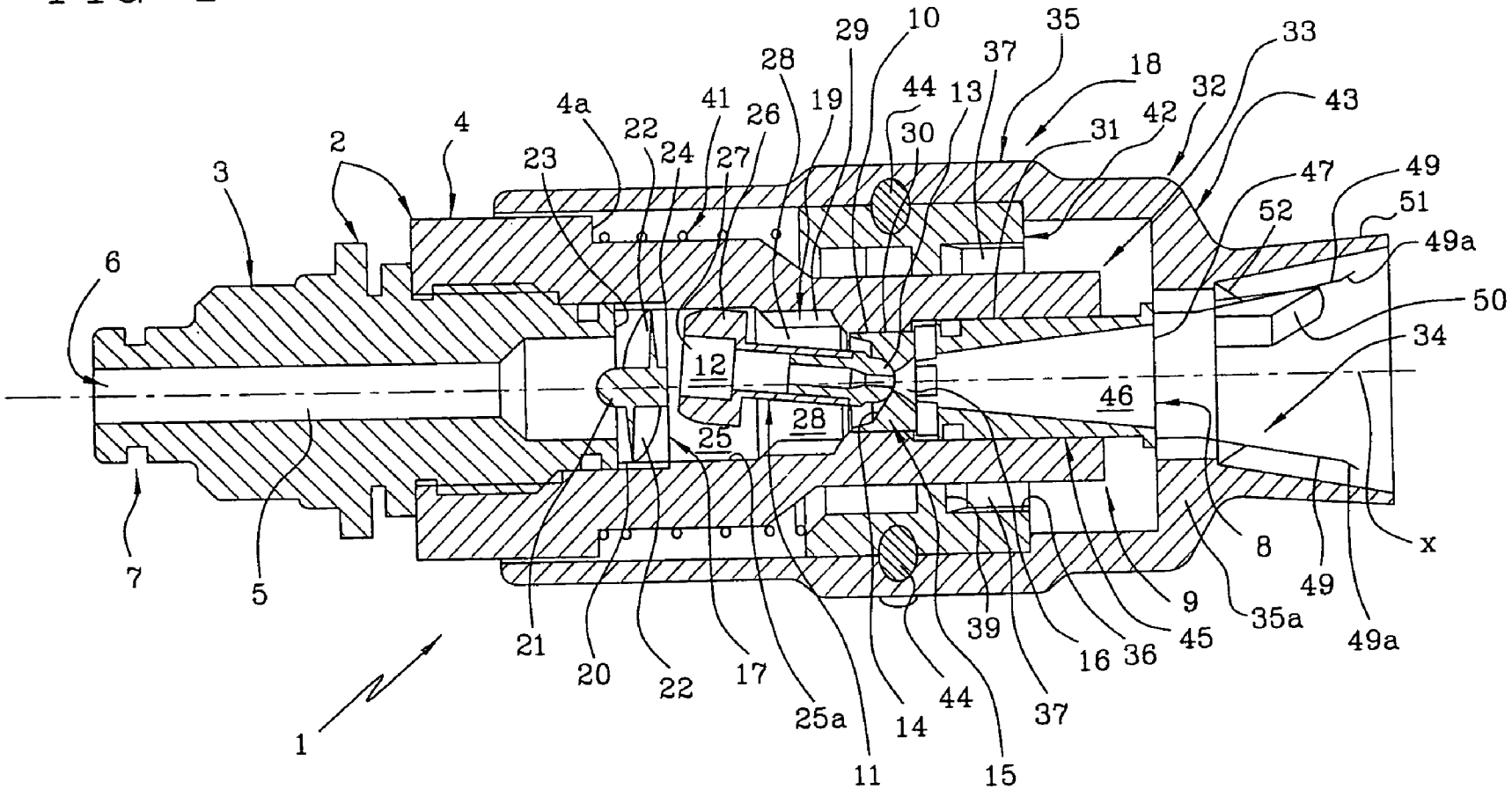
FIG. 1 shows a longitudinal section of the multi-function head for water-cleaning guns of the invention, in a first operating position, corresponding to operation with rotating nozzle.

With reference to the figures of the drawings, the multi-function head of the invention is denoted in its entirety by 1.

With reference to FIGS. 1–4, the head 1 comprises a tubular first main body 2 constituted by a first portion 3 screwed into a second portion 4.

The first main body 2 exhibits a conduit 5, preferably circular in section, which extends at least partially along a longitudinal axis X from an inlet 6, located at a rear end 7 of the first main body 2, up to an outlet 8, defined at a front end 8 of the first main body 2. The rear end 7 is specially shaped to be connected to a tube, not illustrated, for supply of a washing liquid at high pressure.

The conduit 5 advantageously exhibits a portion having a narrowed transversal section 10 at which the organs determining the type of flow issued from the head 1 are located.

In particular, a nozzle 11 is housed in the conduit 5, the nozzle 11 having a passage 12 for the washing liquid and resting at a front end 13 thereof in a frustoconical seating 14 defined on an auxiliary body 15. The auxiliary body 15 exhibits a passage 16 which faces the passage 12 of the nozzle 11, and has a breadth transversal to the axis X which is about the same as the section of the narrowed portion 10.

Means for conveying 17 the washing liquid are interpositioned between the inlet 6 and the narrowed portion 10 and upstream of the nozzle 11 form at least one jet which is oblique with respect to the longitudinal axis X, in order to impress on the nozzle 11, at a determined operative position of the head 1 (better described herein below) a rotary and conical motion with a vertex in the frustoconical seating 14.

Advantageously means for regulating 18 the trim of the head 1 enable a translation of the auxiliary body 15 and the nozzle 11 along the longitudinal axis X into at least three operating positions.

In a first operating position, a retracted position illustrated in FIG. 1, the auxiliary body 15 is located in the narrowed portion 10 and, given that it entirely occupies the narrowed portion 10, the flow of washing fluid can only flow into the passage 16. At the same time the nozzle 11 can move rotatingly and conically with a centre in the seating 14 of the auxiliary body 15, and a high-pressure rotating jet obtains.

Figure 2:
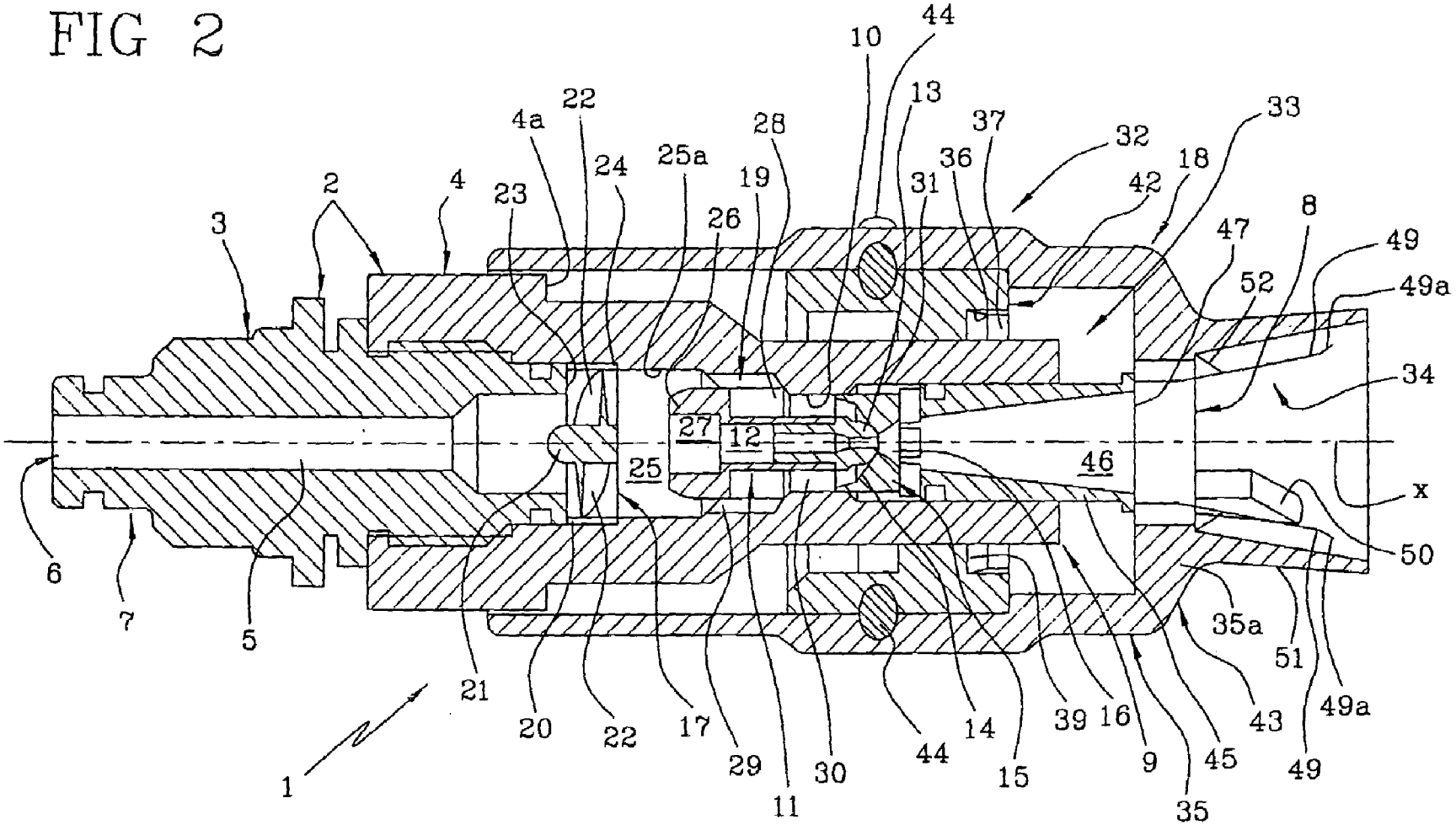
FIG. 2 is the head of FIG. 1 in a second operating position, corresponding to operation with a high-pressure directed jet.

In a second intermediate operating position, illustrated in FIG. 2, the auxiliary body 15 is still located in the narrowed portion, in order to enable the washing liquid flow in the passage of the auxiliary body 15.

Further, the nozzle 11 is blocked in line with the longitudinal axis X by means for blocking 19, in order to obtain a high-pressure fixed jet.

Figure 3:
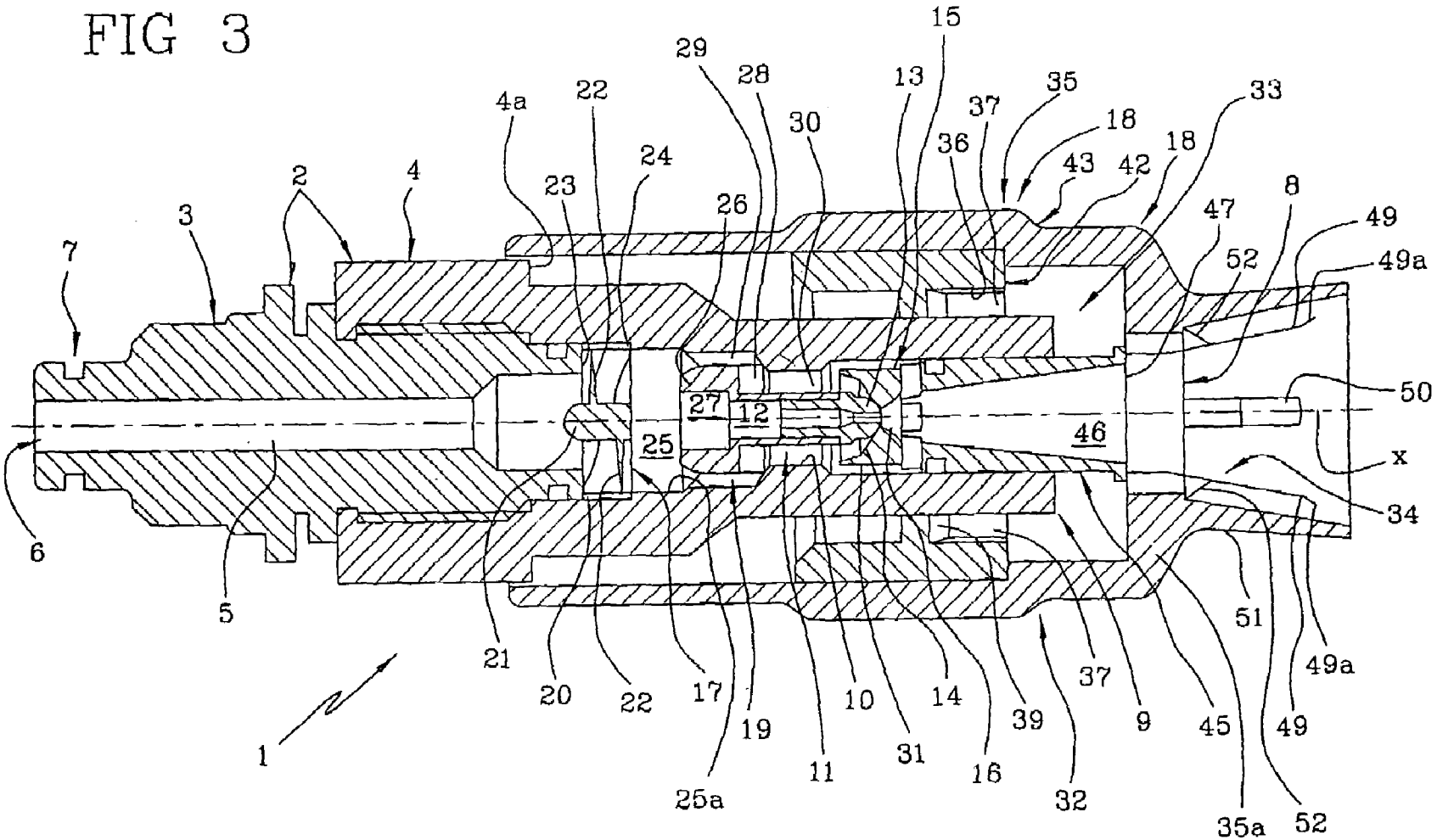
FIG. 3 shows the head of FIG. 1 in a third operating position, corresponding to operating with the jet at a low pressure.

In a third operating position, the auxiliary body 15 is uncoupled from the narrowed section 10 in order to allow passage of the washing liquid around the auxiliary body 15, and the nozzle 11 is blocked in line with the longitudinal axis X of the means for blocking 19, in order to obtain a low-pressure fixed jet. (FIG. 3).

Figure 7:
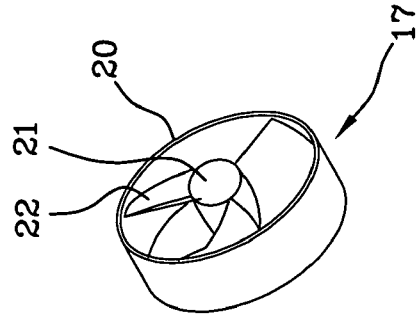
FIG. 7 is a perspective view of a second element of the head illustrated in FIGS. 1, 2, 3 and 4.

More specifically as regards the structural details, in the preferred and illustrated embodiment, the means for conveying 17 the washing liquid are defined by a propeller which is solidly constrained to the first main body 2, giving the flow a rotary motion. In more detail, as can be seen in FIG. 7, the propeller 17 comprises a cylindrical body 20 and a spinner 21 between which the propeller blades 22 stretch. The cylindrical body 20 is inserted in the conduit 5 between a front end 23 of the first portion 3 of the first main body 2 and a shoulder 24 afforded in the second portion 4.

Alternatively, in a design of known type and not illustrated, the means for conveying 17 are defined by a closure element which exhibits at least one through-hole skewed with respect to the longitudinal axis X so as to form the oblique jet.

Downstream of the propeller 17, in the conduit, the nozzle and the auxiliary body 15 are installed.

The portion of conduit 5 in which the nozzle 11 and the auxiliary body 15 are installed is constituted by four axially-aligned zones.

A first zone 25, located in proximity of the means for conveying 17, is larger than a rear end 26 of the nozzle 11 in order to allow the rear end 26 to rotate on the internal wall 25*a* of the conduit 5, when the head 1 is in the first operating position. For this purpose the rear end 26 of the nozzle is larger in transversal section 26 than the front end 13, 50 that the nozzle 11 is not too inclined with respect to the longitudinal axis X during rotation. Furthermore, the passage 12 in the nozzle 11 exhibits a lip 27 at the rear end 26 which lip 27 is wider than the outlet at the front end 13, in order to favour inlet of the liquid also during rotation.

A second zone 28, located downstream of the first zone 25, is provided with a plurality of fins 29 located upstream of the narrowed section 10 and extending radially from the internal wall of the conduit 5, in order to define the means for blocking 19 the nozzle 11 in the second and third operating positions of the head 1. As is visible in FIGS. 2 and 3, the fins 29 reduce the section of the conduit 5 so that it is more or less equal to the transversal breadth of the rear end 26 of the nozzle 11.

A third zone 30, located downstream of the second zone 28, defines the narrowed portion 10 which receives the auxiliary body 15 in the first and the second operating positions of the head 1.

Finally, a fourth zone 31, located downstream of the third zone 30, exhibits a larger size than the auxiliary body 15, so that, when in the third operating position of the head 1 the auxiliary body 15 is inside the head 1 and the flow can pass around the auxiliary body 15.

The means for regulating 18 comprise a command organ 32 arranged at least partially around a front portion 33 of the first main body 2 and manually operated so as to be translated at least along the longitudinal axis X. The command organ 32 defines a front stop, in at least three operating positions, for the auxiliary body 15 pushed by the liquid flow, and displaces the auxiliary body 15 between the three operating positions.

In the preferred and illustrated embodiment, the means for regulating 18 also enable the head 1 to be brought into a fourth operating position, which corresponds to the activation of a jet-breaking device 34 which leads to a fanned jet issuing from the head 1.

In more detail, the command organ 32 comprises a tubular second main body 35 which is coaxially mounted about the first main body 2 and which exhibits an internal surface 36 which is provided with a plurality of recesses 37 that can engage with a projection 38 which is solidly constrained on the first main body 2. The second main body 35 is axially and rotatably mobile with respect to the first main body 2, and alternatively engages the projection 38 with one of the recesses 37 at each operating position.

Figure 9:
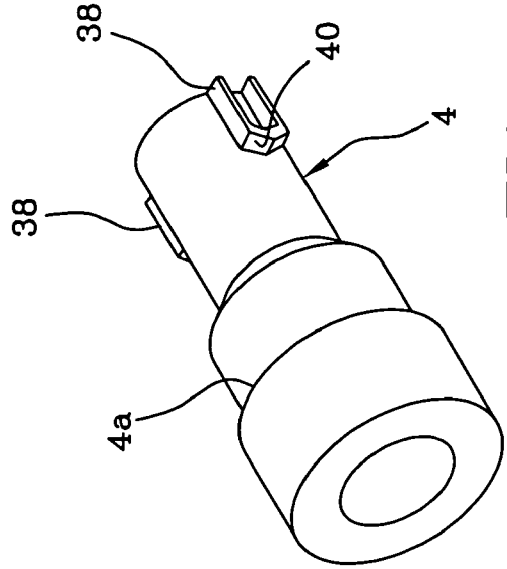
FIG. 9 is a perspective view of a fourth element of the head illustrated in FIGS. 1, 2, 3 and 4.
Figure 5:
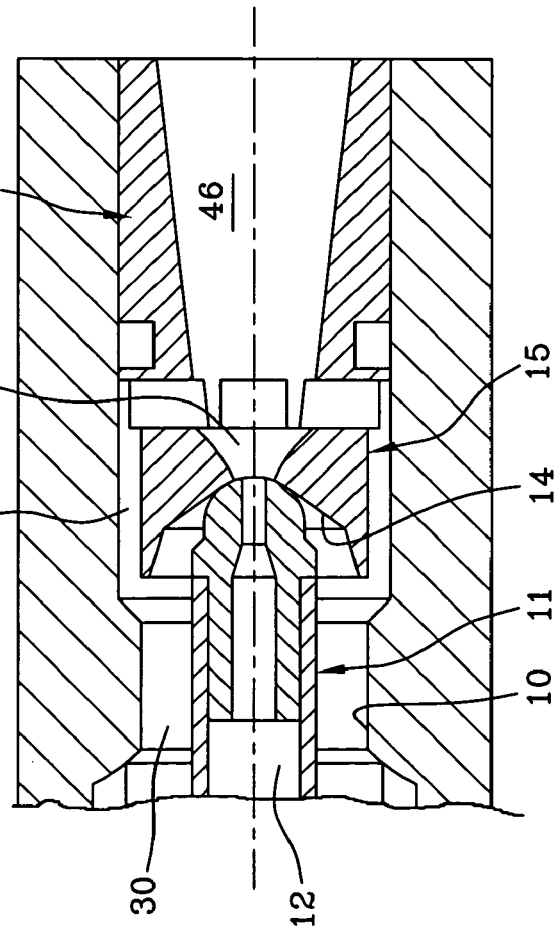
FIG. 5 is an enlarged view of a portion of the head of FIG. 3.

Preferably, as illustrated in FIG. 9, the second portion 4 of the first main body 2 exhibits a pair of projections 38 which are engageable alternatively in four pairs of recesses 37 corresponding to the four above-mentioned operating positions.

In the preferred and illustrated embodiment, the second main body 35 comprises an internal first portion 42, which coaxially surrounds the second portion 4 of the first main body 2, and an external second portion 43, which coaxially surrounds the internal first portion 42. The first 42 and the second 43 portions of the second main body 35 are solidly connected by pins 44, and thus move axially and rotatably together on the first main body 2.

Each of the recesses 37 is defined by an axial channel exhibiting in at least two operating positions a striker 39 for a corresponding striker surface 40 of the projection 38.

In the low-pressure operating position alone (FIG. 3) the pair of recesses 37 extends over the whole length of the internal first portion 42, using the connecting pin 44 as a striker surface 40 of the projection 38.

An elastic element 41 keeps the striker surface 40 of the projection 38 close by or in contact with a striker 39 of one of the recesses 37, or against the connection pin 44, in relation to the selected operating position.

Figure 8:
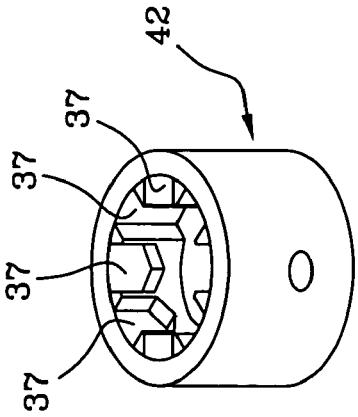
FIG. 8 is a perspective view of a third element of the head illustrated in FIGS. 1, 2, 3 and 4.

As clearly illustrated in FIG. 8, the internal first portion 42 of the second main body 35 is defined by a cylinder, an internal surface of which exhibits the pairs of recesses 37. Different pairs of recesses 37 extend axially for different lengths, so that different axial positions of the second main body 35, the nozzle 11 and the auxiliary body 15 correspond to different operating positions of the head 1.

A spacer 45 is located between the auxiliary body 15, internally of the conduit 5, and the second main body 35, a front portion 35*a* of which extends partially in advance of the outlet 8. The spacer 45 is located in the fourth zone 31 of the conduit 5 and exhibits a passage 46 for the fluid, which passage is coaxial to the longitudinal axis X and faces the passage 16 of the auxiliary body 15. The passage 46 of the spacer diverges towards the outlet 8.

The elastic element 41 is a helix spring which surrounds the second portion 4 of the first main body 2 and faces against a shoulder 4*a* of the second portion 4, and at the other end thereof against the cylindrical internal first portion 42 of the second main body 35.

Figure 6:
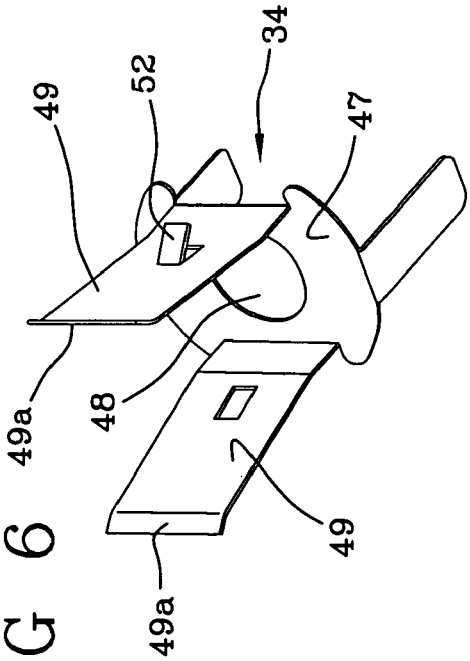
FIG. 6 is a perspective view of a first element of the head illustrated in FIGS. 1, 2, 3 and 4.

Finally, according to what is illustrated in FIG. 6, the jet-breaking device 34 comprises a disc 47 interpositioned between the spacer 45 and the front portion 35*a* of the second main body 35, perpendicular to the longitudinal axis X. The disc 47 exhibits an opening 48, coaxial to the longitudinal axis X, and two elastic blades 49 which extend from opposite sides of the disc 47, transversally to the disc 47 itself.

Figure 4:
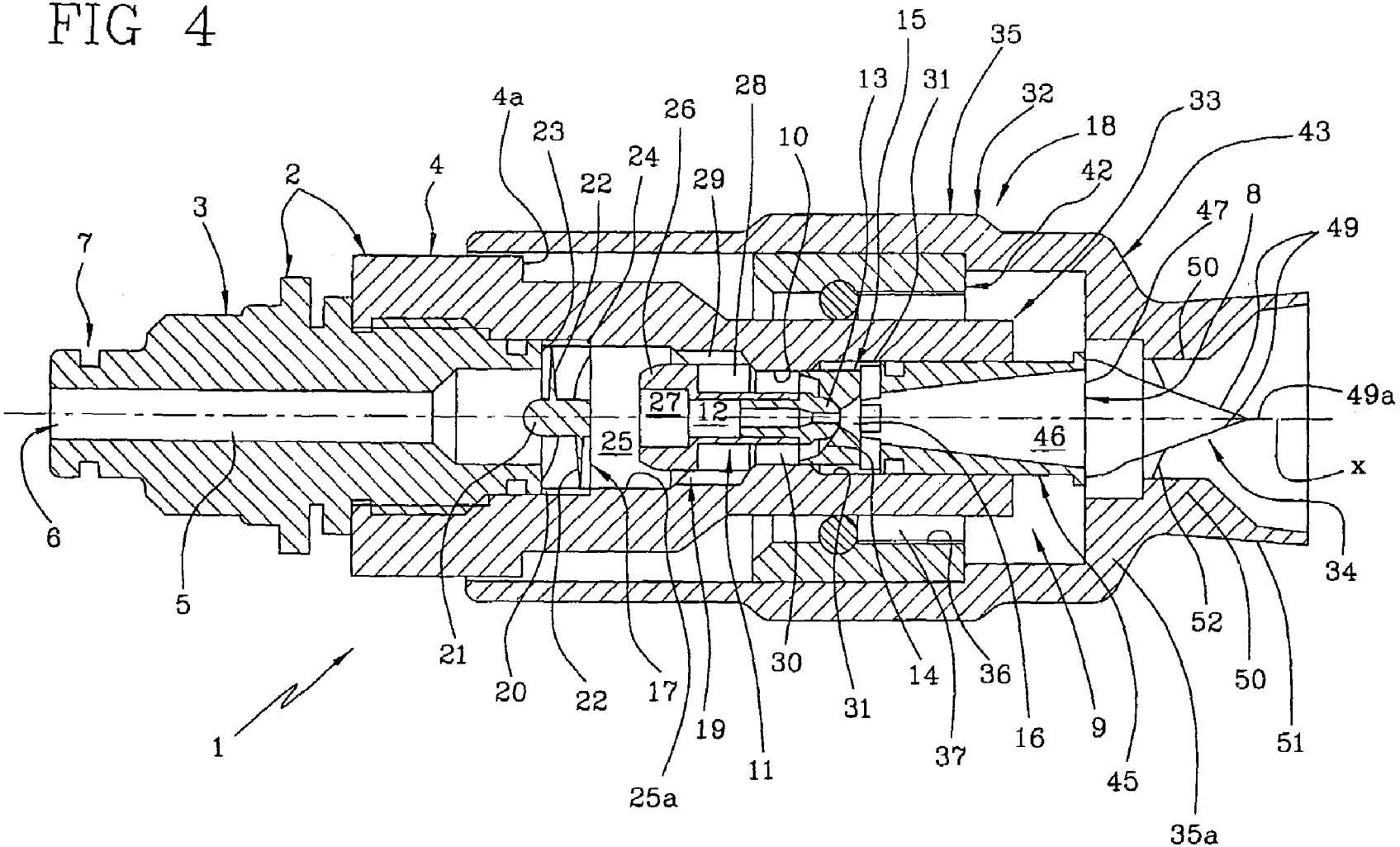
FIG. 4 shows the head of FIG. 1 in a fourth operating position, corresponding to operation with the fixed fanned jet.

The blades 49 are mobile between a first position in which they lie reciprocally distant and parallel (FIGS. 1, 2, 3 and 6), and a second position, corresponding to the fourth operating position of the head 1, in which the ends 49*a* are in reciprocal contact, in order to interfere with the flow expelled from the outlet 8 (FIG. 4).

The movement of the blades 49 is determined by a pair of projections 50, situated internally of an outlet mouth 51 of the second main body 35, which enter into contact with appendices 52 of the blades 49 during the rotation of the second main body 35 in order to move into the fourth operating position.

During operation, in the first operating position shown in FIG. 1, the axial position of the second main body 35 with respect to the first main body 2 and the pressure exerted by the liquid on the nozzle 11 on the auxiliary body 15 and the spacer 45 keep the auxiliary body 15 in the third zone 30 of the conduit 5, while the rear end 26 of the nozzle 11 rolls on the internal wall 25*a* of the conduit 5. The liquid flows across the passages 12, 16 of the nozzle 11 and the auxiliary body 15.

When it is desired to change the type of jet, a user pushes the second main body 35 towards the first main body 2 against the spring 41. The displacement disengages the projections 38 from the recesses 37 and the user can rotate the second main body 35 with respect to the first main body 2, bringing the projections 38 into position with a pair of recesses 37 corresponding to the pre-selected operating position of the head 1.

By releasing the second main body 35, the spring 41 pushes the second main body 35 away from the first main body 2 and causes the projections 38 to engage with the pre-selected recesses 37.

The invention offers important advantages.

The head 1 of the invention, with a single nozzle, can selectively provide two or three different types of jet, by a simple change in the nozzle trim in the conduit in which it is contained; the regulation maneuver is easy and rapid and offers a choice between the rotating jet, the single high-pressure directed jet and the low pressure jet and the fanned jet.

Finally, it is of note that the head of the invention is compact, light, reliable and simple from a constructional point of view. These characteristics, apart from offering the user a high level of performance, considerably reduce manufacturing costs.

What is claimed is:

1. A multi-function head for high-pressure washing guns, in particular for water cleaning machines, comprising:

a tubular first main body exhibiting a rear end, a front end and a conduit for a washing liquid; the conduit extending at least partially along a longitudinal axis from an inlet, afforded at the rear end of the first main body, to an outlet, afforded at the front end of the first main body; the conduit further exhibiting a portion having a narrowed section;

a nozzle housed in the conduit of the first main body and exhibiting a passage;

an auxiliary body inserted in the conduit of the first main body and exhibiting a passage facing the passage of the nozzle; the auxiliary body exhibiting a frustoconical striker seating for a front end of the nozzle;

conveying means interpositioned between the inlet and the portion having the narrowed section for conveying the washing liquid and forming upstream of the nozzle at least a jet which is oblique to the longitudinal axis so as to impress on the nozzle a rotating and conical motion with a vertex in the frustoconical seating;

regulating means for trimming the head and moving together the auxiliary body and the nozzle along the longitudinal axis between:

a retracted first operating position, in which the auxiliary body is located in the portion having the narrowed section, in order to enable a flow of washing liquid in the passage of the auxiliary body, and the nozzle can move rotatingly and conically in order to obtain a high-pressure rotating jet;

an intermediate second operating position, in which the auxiliary body is located in the portion having the narrowed section, in order to enable a flow of washing liquid in the passage of the auxiliary body, and in which the nozzle is blocked in line with the longitudinal axis by means for blocking, for obtaining a high-pressure fixed jet;

an advanced third operating position, in which the auxiliary body is uncoupled from the portion having the narrow section, in order to enable passage of the washing liquid around the auxiliary body, and the nozzle is blocked in line with the longitudinal axis of the means for blocking, for obtaining a low-pressure fixed jet.

2. The head of claim 1, wherein the regulating means for trimming the head comprise a command organ arranged at least partially around a front end of the first main body and are manually activated in order to be translated at least along the longitudinal axis; the command organ acting as a striker, in at least three operating positions, for the auxiliary body pushed by the flow of liquid, and displacing the auxiliary body between the at least three operating positions.

3. The head of claim 2, wherein the command organ comprises a tubular second main body which is mounted coaxially around the first main body and which exhibits an internal surface which is provided with a plurality of recesses which can be engaged with at least one projection which is solidly constrained to the first main body; the second main body being axially mobile and rotatable with respect to the first main body in order to engage, alternatively, the at least one projection with a recess of the plurality of recesses at each of the at least three operating positions.

4. The head of claim 3, wherein at least two of the plurality of recesses are constituted by an axial channel inferiorly defining a radially developing striker, on which a radial surface of the at least one projection can rest.

5. The head of claim 4, wherein it further comprises an elastic element for maintaining the striker surface of the at least one projection against a respective striker in each of the operating positions.

6. The head of claim 1, wherein the conveying means for conveying the washing liquid are constituted by a propeller solidly constrained to the first main body for forming the at least one oblique jet.

7. The head of claim 1, wherein the conveying means for conveying the washing liquid are constituted by a closure element exhibiting at least a through hole for forming the at least one oblique jet.

8. The head of claim 1, wherein the means for blocking the nozzle comprise a plurality of fins located upstream of the portion having a narrowed section and extending radially from an internal wall of the conduit.

9. The head of claim 3, wherein it further comprises a jet-breaking device for obtaining a fanned jet in outlet from the head, which jet-breaking device is activated by the means for regulating in a fourth operating position of the head.

10. The head of claim 9, wherein it comprises a pair of projections which can alternatively be arranged in four pairs of recesses corresponding to the four operating positions.

11. The head of claim 1, wherein it further comprises a jet-breaking device for obtaining a fanned jet in outlet from the head, which jet-breaking device is activated by the means for regulating in a fourth operating position of the head.

* * * * *